United States Patent [19]

Hutchison, III

[11] 4,111,399

[45] Sep. 5, 1978

[54] PANEL FENCE

[75] Inventor: George G. Hutchison, III, Englewood, Colo.

[73] Assignee: Hutchison-Western, Adams City, Colo.

[21] Appl. No.: 787,046

[22] Filed: Apr. 13, 1977

[51] Int. Cl.[2] ..... B21F 27/00

[52] U.S. Cl. ..... 256/32; 245/8; 256/24

[58] Field of Search ..... 256/45, 33, 32, 46, 256/24; 245/2, 8, 10

[56] References Cited

U.S. PATENT DOCUMENTS

| | | | |
|---|---|---|---|
| 905,942 | 12/1908 | Smith | 256/45 |
| 1,297,169 | 3/1919 | Hoepf | 256/52 |
| 1,378,489 | 5/1921 | Sommer | 248/8 |

FOREIGN PATENT DOCUMENTS

| | | | |
|---|---|---|---|
| 863,038 | 2/1971 | Canada | 256/32 |
| 1,923,777 | 8/1970 | Fed. Rep. of Germany | 256/33 |
| 27,310 of | 1911 | United Kingdom | 256/45 |

*Primary Examiner*—Andrew V. Kundrat
*Attorney, Agent, or Firm*—John E. Reilly; James R. Young

[57] ABSTRACT

Fence sections of the type having a series of interconnected vertical and horizontal strands are characterized by being formed with different preselected gauges and spacing between the horizontal strands. Thus the horizontal strands located at the extreme ends of the vertical strands are of a heavier gauge than the vertical strands with the intermediate horizontal strands being equal to or lighter in gauge than the vertical strands, the gauges and density or spacing of these strands being selected so as to allow coiling of the fence without having a retained memory factor while at the same time providing vertical strength against collapsing forces. Preferably, the spacing between the horizontal strands successively increases from the bottom of one such vertical row to the top of the vertical row, with each successively higher opening or spacing being greater than or equal to the vertical length of its next lower adjacent space or opening.

6 Claims, 4 Drawing Figures

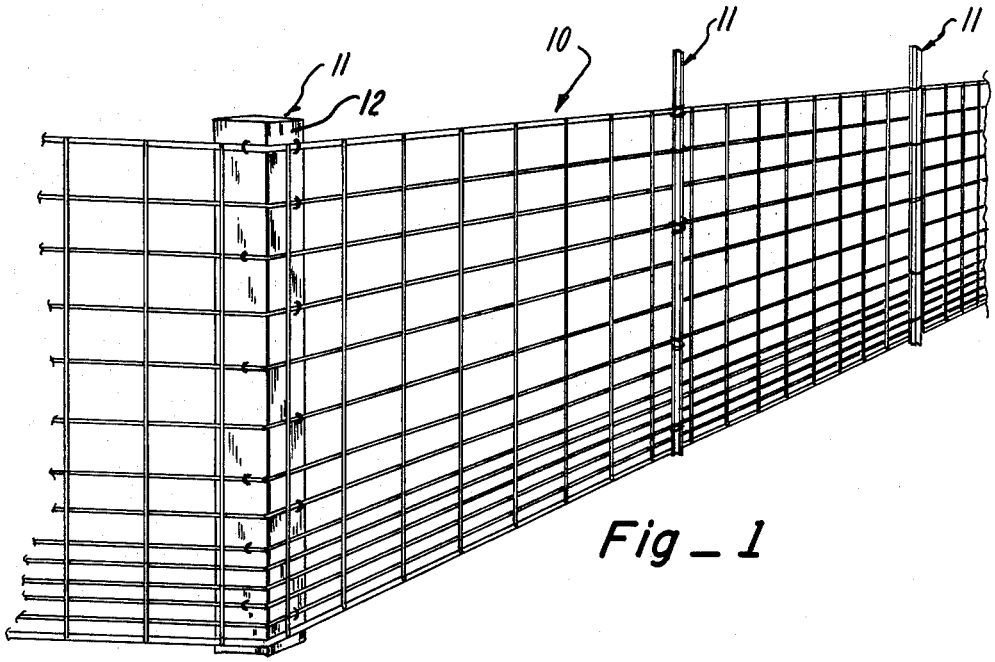
Fig_1
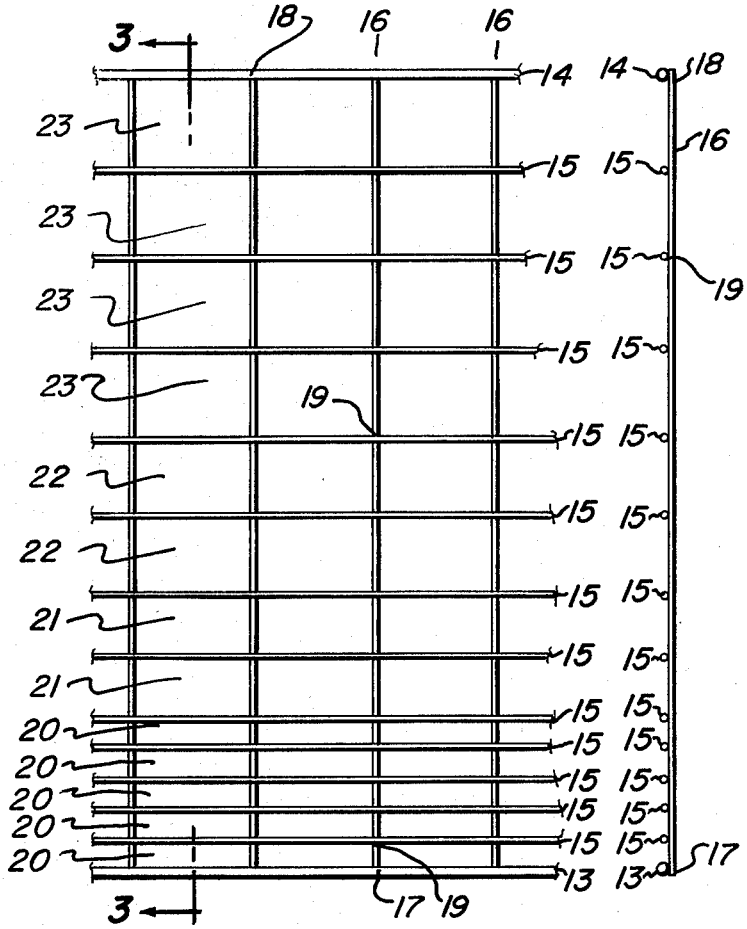
Fig_2
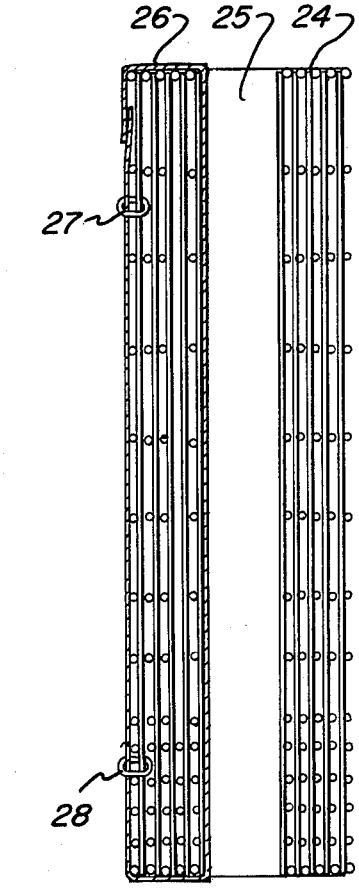
Fig_3
Fig_4

PANEL FENCE

BACKGROUND OF THE INVENTION

The present invention relates to novel and improved fencing, and more particularly relates to fencing of the type which can be coiled for shipment, then unwound for mounting between posts, while at the same time being of sufficient strength so as not to collapse when an animal pushes against the fence.

Various problems have confronted users of traditional fences, specifically woven wire fences, since these structures exhibit certain undesired characteristics. Predominant among these characteristics is that of memory factor which is a condition wherein the fence seeks to return to a position it has once occupied. Woven wire fences are traditionally coiled in vertical cylinders. When these fences are uncoiled the memory factor causes the fence to tend to return into a coiled position thereby making it difficult to manage as it is being erected. Another common tendency for these fences is that they will collapse under even slight vertical pressures exerted along their horizontal strands since the vertical strands provide no support for the horizontal strands.

Therefore, a need has existed for a fence having sections of extended length which can be coiled for storage or shipment but when uncoiled exhibits the same characteristics as fencing of much greater weight and overall strength. For instance, in use the fence should be so designed as to prevent animals from getting their hooves or feet entangled with the lower portions of the fence which could otherwise result in injury to the animal as it struggles to extricate itself. Additionally, the fence should be designed so as to adequately contain the smaller animals as well as the larger ones. While previous attempts to satisfy this problem have resulted in fences wherein the lower openings of a woven wire fence are of less vertical length than the upper openings, the lack of vertical support by the vertical strands has reduced the effectiveness of this design insofar as a small animal is able to upwardly collapse the fence in a vertical direction thereby enabling the small animal to escape. Furthermore, even though openings or spaces are provided at the bottom of the fence, the lack of rigidity does not prevent the entanglement of the hooves or feet of the animals since the weight of the animal will cause an enlargement of the opening should the animal step upon the fence.

SUMMARY OF THE INVENTION

The present invention was developed and conceived to remedy the problems confronting traditional woven wire fences, namely, memory factor of coiling, lack of rigidity, economy in construction, and protection to the animals enclosed therein.

To this end, the fence is constructed to include an upper and lower horizontal strand attached at each extreme end of a vertical strand. Intermediate horizontal strands are provided so that a series of openings is defined by the inner section of the horizontal strands and the vertical strands. The common gauge of the vertical strands is selected to provide sufficient vertical rigidity to prevent collapsing forces either downwardly directed due to large animals pushing on the top of the fence or from upwardly directed collapsing forces resulting from smaller animals pushing upward on a lower portion of the fence. A cooperation is found between the gauge of the vertical strands and the longitudinal density of vertical strands so as to resist these collapsing forces. On the other hand, if all of the horizontal strands were of the same or greater gauge as the vertical strands coiling of extended lengths of the fencing would be virtually impossible and would also result in a substantial weight increase.

The horizontal strands are of selected gauges so as to allow the coiling of the fence in a tightly wound manner while at the same time avoiding the accompanying problem of memory factor which has plagued the prior art. In this manner, a simultaneous solution is achieved to maximize the efficiency obtained in these variables.

Also, the horizontal strands are attached along the vertical strands so as to define a plurality of vertical rows of openings. The lowermost openings are of a smaller vertical length, intermediate openings are of greater vertical length, and the uppermost spacing is of the greatest vertical length. In this manner, a fence of substantial vertical length may be obtained without having an excess bulkiness while at the same time small openings may be located near the lower portion of the fence to prevent damage to hooves or feet and to prevent the escape of smaller animals.

It follows that an object of the invention is to provide a novel and improved fencing structure which will exhibit substantial vertical and horizontal strength but will permit coiling without retention of a substantial memory factor upon subsequent uncoiling.

A further objective of the present invention is to provide a fence wherein a vertical series of openings or spaces is formed so that lower openings are provided to prevent damage to animal hooves or feet and which will allow the use of the fence when small animals are to be contained while at the same time providing a fence of substantial vertical length which is not excessively bulky or heavy.

Another object of the present invention is to provide a galvanized fence wherein the vertical strands and horizontal strands are welded at each intersection thereof.

With the foregoing and other objects in view, the present invention comprises certain constructions, combinations and arrangements of parts and elements as hereinafter described, defined in the appended claims and illustrated in preferred embodiment by the accompanying drawings.

BRIEF DESCRIPTION OF THE DRAWINGS

FIG. 1 is an elevational view of an erected fence in accordance with the present invention;

FIG. 2 is a front view of a cutaway section of the panel fence in accordance with the present invention;

FIG. 3 is a cross-sectional view taken about lines 3—3 of FIG. 2; and FIG. 4 is a view in cross-section of a cylindrical coil of the fence according to the present invention.

DETAILED DESCRIPTION OF THE PREFERRED EMBODIMENT

Referring in more detail to the drawings, there is illustrated in FIG. 1 an erected fence utilizing the present invention. Specifically, a section of the fence 10 is shown attached to a plurality of posts 11. At each post 11, a number of standard fasteners 12 are utilized to mount the fence thereon. It is to be understood that the fence 10 may be attached to a variety of types of posts utilizing staples, wire clips or other fasteners compatible with the type of post chosen according to standard practice.

As is best shown in FIGS. 2 and 3, the preferred embodiment of this fence is constructed as a series of horizontal and vertical strands of heavy guage wire. Each of the wires is a standard gauge, galvanized steel rod, but the gauges of which are chosen as hereinafter described. A bottom horizontal strand 13 and a top horizontal strand 14 are attached at each end of the plurality of vertical strands 16. In the preferred embodiment, each attachment point 17 and 18 consists of an electronically welded portion permanently securing the horizontal strands and the vertical strands in perpendicular relation. A plurality of intermediate horizontal strands 15 are electronically welded at points 19 so that the intermediate horizontal strands 15 lay between the bottom horizontal strand 13 and the top horizontal strand 14. Preferably, the intermediate horizontal strands 15 are located on the same lateral side of vertical strands 16 as are the top and bottom horizontal strands. Furthermore, while the intermediate horizontal strands 15 and the vertical strands 16 are of a common gauge, the bottom horizontal strand 13 and the top horizontal strand 14 are of a common heavier gauge than both the intermediate horizontal strands and the vertical strands. Typically, the intermediate horizontal strands are of six gauge material, while the remaining horizontal strands are constructed out of four gauge material.

The intersections of the horizontal strands with the vertical strands define the corners of a plurality of openings. The openings so defined are progressively larger in vertical length in succession from the lowermost opening to the uppermost opening, so that for any given opening or vertical spacing, the vertical length is either greater than or equal to the vertical length of the next adjacent opening immediately below it. That is, openings 20 located at the bottom of the fence are least in vertical lengths or spacings, openings 21 are located immediately above openings 20 and are greater in vertical length or spacing than openings 20, openings 22 are disposed above openings 21 and are yet of greater vertical length or spacing than opening 21, and finally, openings 23 are located above openings 22 and are of greater vertical length or spacing than openings 22.

While it is foreseen that any given vertical row of openings, their number and combination may be varied with the parameter of increasing vertical lengths from bottom to top, the preferred embodiment consists of five lowermost openings 20 which are approximately 5.08 cm in vertical length. Immediately above these five lowermost openings are two intermediate openings 21 which are approximately 10.16 cm in vertical length, above which are two more intermediate openings 22 which are approximately 12.70 cm in vertical length. Finally, four openings 23 are formed at the top of the fence and are approximately 15.24 cm in vertical length.

The horizontal lengths of each vertical row of openings is determined by the distance separating the vertical strands 16, which strands are parallel to one another. In the preferred embodiment, the vertical strands 16 are placed approximately 20.32 cm from one another. An important feature of the present invention resides in the selection of gauges for the intermediate horizontal strands 15 and the vertical strands 16 for there is a cooperation between the gauges and vertical spacing as shall be further described herein.

A coil 24 of the preferred embodiment fence is shown in FIG. 4. This vertical coil is tightly would about an open core 25 which is approximately 43.18 cm in diameter. The lengths of a section of the fence so wound in a vertical cylinder may be varied, but lengths of approximately 30 meters and 50 meters are usually selected for convenience. To prevent the coil from unwinding, a band 26 is placed around a section of the vertical cylinder. This band extends vertically downward from an outer portion of the vertical cylinder where it turns under the bottom of the vertical cylinder in a radial direction, and, on reaching the inner core portion of this cylinder, extends vertically upward for the length thereof. At the uppermost point of the core, band 26 turns radially outward and proceeds along an upper radial portion of the vertical cylinder until it reaches the outer circumference where it returns once again vertically downward and overlaps a portion of its own length. A pair of clips 27 and 28 releasably secure bands 26 so that the vertical coil of fence is prevented from uncoiling until such time as desired.

As mentioned above, a certain cooperation exists between the various elements of this invention. A first parameter which is to be satisfied is that of the selection of a guage of wire for the horizontal strands so that when the fence is uncoiled, the fence will not retain a memory factor of its previously coiled position. That is, the fence should not have a tendency to recoil itself once taken off the cylinder. At the same time, however, it is desired to compactly coil the fence in order to avoid bulkiness in handling and hence the gauge of the horizontal strands must be such as to allow coiling about a small core.

A second parameter to be met is that of substantial vertical strength against collapsing forces. It is highly desirable to provide a fencing structure wherein the supporting posts may be placed some distance apart while at the same time sacrifice is not made of the vertical strength of the fence between two successive posts. In the present invention, by providing substantially rigid vertical strands of a common gauge, such resistance to vertical collapsing forces may be achieved by properly spacing the vertical strands while at the same time avoiding an inordinately bulky coil of fencing material.

Therefore, it is seen that the present invention resides in the simultaneous solution to the problems of bulkiness, vertical strength, and memory factor which have created numerous problems for the fencing of livestock and the like. To meet the needs of the exacting use of a fencing structure, heavy gauge top and bottom strands allow strength in the erection of this fence and gives extra strength to the fence as livestock come in contact with it. The lighter gauge interior wires allow the fence to be coiled about a minimum core, thereby avoiding the problem of memory factor when the wire is uncoiled and used in a straight fence line. While in the preferred embodiment the interior horizontal wires are of common gauge, it is to be understood that the vertical strands may be of a heavier gauge, such as, five gauge rod, so as to increase vertical strength without sacrificing coilability. An additional advantage is gained by the use of progressively larger openings from the lower point of the fence to the upper point in that this spacing is designed so that livestock of all sizes can be protected from damage to their hooves and body contact. Small animals cannot step through the lower section of the fence while at the same time bulkiness is avoided by having larger openings at the upper portion of the fence.

Other advantages of the present invention will be readily apparent to those skilled in the art, and it is further to be understood that while a preferred form only of the present invention has been set forth and described, various modifications and changes may be made therein without departing from the spirit and scope of the present invention as defined by the appended claims.

What is claimed is:

1. In a wire fence section having a plurality of horizontal strands and a plurality of vertical strands, said fence adapted for being coiled in a vertical cylinder, the improvement comprising in combination:

vertical strands of a selected gauge;

first and second horizontal strands welded to opposite ends of said vertical strands, said first and second horizontal strands having a common gauge heavier than said vertical strands;

a plurality of intermediate horizontal strands between said first and second horizontal strands reduced in gauge to have a common gauge lighter than said vertical strands, said intermediate horizontal strands and said vertical strands welded at respective points of intersection;

a rectangular array of openings defined by said first and second horizontal strands, said intermediate horizontal strands and said vertical strands wherein the vertical spacing between horizontal strands increases in the direction of reduction in the gauge of said horizontal strands from the lowest horizontal strand toward said intermediate horizontal strands; and gauges of the horizontal strands being such as to allow the coilng of a 30 meter section of said fence about a tightly wound core of less than 50 cm diameter, said section when uncoiled not retaining substantial memory factor, and the gauge of said vertical strands being such that said vertical strands are substantially rigid for providing resistance against downwardly or upwardly directed collapsing forces on said first and said horizontal strands and said intermediate horizontal strands.

2. In a wire fence according to claim 1, gauges of said first and second horizontal strands, said intermediate horizontals strands and said vertical strands selected to allow said core to be of less than 50 cm in diameter.

3. In a wire fence according to claim 2, said fence having a length greater than or equal to 30 meters.

4. In a wire fence according to claim 1, said vertical strands being substantially rigid for providing resistance against downwardly or upwardly directed collapsing forces on said first and second horizontal strands and said intermediate horizontal strands.

5. In a wire fence according to claim 1, whereas said first and second horizontal strands, said intermediate horizontal strands and said vertical strands are welded together at each intersection thereof.

6. An improved wire fence according to claim 1 having lowermost openings between said lowest horizontal strand and its adjacent horizontal strand and first intermediate openings disposed above said lowermost openings, and second intermediate openings disposed above said first intermediate openings, and uppermost openings between an uppermost horizontal strand and its adjacent intermediate horizontal strand, said lowermost openings having a vertical height of approximately 5.08 cm, said first intermediate openings having a vertical height of approximately 10.16 cm, said second intermediate openings having a vertical height of approximately 12.70 cm, and uppermost openings having a vertical height of approximately 15.24 cm.

* * * * *

UNITED STATES PATENT OFFICE

CERTIFICATE OF CORRECTION

Patent No. 4,111,399 Dated September 5, 1978

Inventor(s) George G. Hutchison, III

It is certified that error appears in the above-identified patent and that said Letters Patent are hereby corrected as shown below:

Column 3, line 68, cancel "would" and substitute -- wound --.

Claim 1, Column 5, line 34, cancel "coilng" and substitute -- coiling --.

Claim 5, Column 6, line 18, cancel "whereas" and substitute -- wherein --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*